US006520695B2

(12) United States Patent
Castellarin et al.

(10) Patent No.: US 6,520,695 B2
(45) Date of Patent: Feb. 18, 2003

(54) PHOTOGRAPHIC PROCESSING CHEMICAL SUPPLIER

(75) Inventors: Silvano Castellarin, Casarsa della Delizia (IT); Eni Scodellaro, Cordenons (IT)

(73) Assignee: San Marco Imaging Srl, Fiume Veneto (Pordenone) (IT)

( * ) Notice: Subject to any disclaimer, the term of this patent is extended or adjusted under 35 U.S.C. 154(b) by 0 days.

(21) Appl. No.: 09/875,763

(22) Filed: Jun. 6, 2001

(65) Prior Publication Data

US 2001/0051050 A1 Dec. 13, 2001

(30) Foreign Application Priority Data

Jun. 7, 2000 (EP) ..... 00111837
Sep. 22, 2000 (EP) ..... 00120184

(51) Int. Cl.[7] ..... G03D 3/02
(52) U.S. Cl. ..... 396/626; 221/232
(58) Field of Search ..... 396/626, 638; 137/268; 221/82, 83, 91–93, 131, 133, 197, 231–234, 247, 248

(56) References Cited

U.S. PATENT DOCUMENTS 5,579,075 A * 11/1996 Hagiwara et al. ..... 396/626

FOREIGN PATENT DOCUMENTS

EP 0 611 987 A1 8/1994

* cited by examiner

*Primary Examiner*—D. Rutledge
(74) *Attorney, Agent, or Firm*—Weingarten, Shurgin, Gagnebin & Lebovici LLP

(57) ABSTRACT

A photographic processing chemical supplier for supplying photographic processing chemicals, in particular dry chemicals in powder form to a developer solution preparing means, comprising: a container having a receiving opening through which said photographic processing chemicals are receivable in said container and a supply opening through which the received photographic processing chemicals are supplyable out of said container to said developer solution preparing means; wherein an attaching means constituted such that a cartridge is removably attachable to the supplier by means of said attaching means; and opening/closing means for opening and closing said receiving opening constituted such that said receiving opening is closed if said cartridge is removed and such that said receiving opening is openable or open if said cartridge is attached.

25 Claims, 8 Drawing Sheets

PHOTOGRAPHIC PROCESSING CHEMICAL SUPPLIER

FIELD OF THE INVENTION

The present invention relates to a photographic processing chemical supplier for supplying photographic processing chemicals, in particular dry chemicals to a developer solution preparing means. Furthermore the invention relates to cartridges and magazines used in connection with the supplier, to a liquid developer solution preparing arrangement comprising the supplier as well as to a photographic minilab for processing photographic films, which comprises the developer solution preparing arrangement.

BACKGROUND OF THE INVENTION

In the field of photofinishing technologies, two types of photofinishing environments are mainly known. One of these types concerns minilabs and the other, large-scale photofinishing laboratories. In the minilabs, all kinds of processing needed for the exposed film, for the exposure of the photosensitive paper and the development of the exposed photosensitive paper as well as all splicing and cutting operations necessary for the exposed and developed film and the exposed and developed photosensitive paper are dealt with in one small scale minilab. This minilab is able to process small to medium numbers of films and is meant for use in retail shops, which implies a standing area of the minilab typically below 5 square meter.

On the other hand, large-scale photofinishing laboratories are able to process a huge number of exposed films, which are arranged in film batches. These film batches are processed in special high-speed printer device.

In minilabs it is useful to conduct most of the operations, if not all operations, automatically without wasting time.

Minilabs include one compartment directed to the development of the exposed film and one compartment directed to the development of the exposed photo paper. In the known minilabs as well as in the known types of large-scale photofinishing laboratories, replenishment of the development compartment is not sufficiently operated automatically and some times has to be replenished, if the developer solution in the development compartment is no longer useful for an acceptable result.

The parallel application of the present application, which has the title "Automatic Replenishment for a Developing Compartment of a Photofinishing Apparatus" (European patent application no. 00 106 025.0), was filed under the title "Automatic Replenishment for a Treatment Compartment of a Photofinishing Apparatus," U.S. patent application Ser. No. 09/818,348, and discloses a developer solution preparing arrangement having a high degree of automation, provides a solution for this problem. The disclosure of the parallel application is incorporated by reference.

According to this parallel application a developer solution preparing arrangement comprises a mixing tank which is located between a supply portion, a reception container and a storage container, wherein said latter parts are connected to the mixing tank by conduits. With this feature it is possible to prepare a new developer solution on the basis of dry components in connection with the solvent, which will usually be water or distilled water, while, at the same time, when mixing the new liquid developer solution, unused and active liquid developer solution is available for the development compartment of a development apparatus in a minilab or in a large scale photofinishing laboratory. Correspondingly, if the fresh liquid development solution has been pumped or withdrawn from the storage container to the development compartment of the development apparatus, the prepared fresh developer solution from the mixing tank can be supplied to the storage container and, immediately afterwards, the components of the development solution can be introduced into the mixing tank to prepare a new charge of the liquid developer solution. This is in particular important if dry ingredients in the form of powder or granules have to be dissolute in the solvent, e.g. water, which takes considerable time which can delay the overall function of the respective development apparatus and, correspondingly, of the complete minilab or the complete large scale photofinishing laboratory.

The above-mentioned components, on the basis of which the liquid developer solution is prepared by combining the components with a solvent, are referred to in the following as photographic processing chemicals. The device, which performs the combination, is referred to as a developer solution preparing means. The present invention relates to the supply of these photographic processing chemicals to a developer solution preparing means by means of a supplier. The combination of the developer solution preparing means and the supplier is referred to as developer solution preparing arrangement.

EP 0 611 987 describes the supply of photographic processing chemicals in the form of powder. The powder is contained in a package, which is attached to a screw supplier. The package is opened by a roller if attached.

SUMMARY OF THE INVENTION

It is an object of the invention to provide a supplier which minimizes the risk of introduction of dirt or dust into the supplier from the outside and to minimize the pollution or contamination of the surrounding of the supplier by spilling out photographic processing chemicals, while allowing an easy replenishment of photographic processing chemicals into the supplier.

Furthermore it is an object to provide a set of the afore-mentioned suppliers for a developer solution preparing arrangement as well as cartridges and magazines for use with the supplier and the set of suppliers and a supply system comprising the cartridges or magazines and the suppliers or set of suppliers. Finally a developer solution preparing arrangement and a photographic minilab comprising said supplier or set of suppliers should be provided.

The above objects are solved by means of a photographic processing chemical supplier for supplying photographic processing chemicals for processing exposed light-sensitive material, in particular dry chemicals, e.g. in powder or granule form, to a processing solution preparing means, comprising: a container having a receiving opening through which said photographic processing chemicals are receivable in said container and a supply opening through which the received photographic processing chemicals are supplyable out of said container to said processing solution preparing means; wherein an attaching means is constituted such that a cartridge is removably attachable to the supplier by means of said attaching means; and opening/closing means for opening and closing said receiving opening constituted such that said receiving opening is closed if said cartridge is removed and such that said receiving opening is openable or open if said cartridge is attached.

The afore-mentioned objects are at least partially solved by the present invention according to which the photographic processing chemicals may be provided in different form, e.g. liquid, powder, and tablet. Preferably the processing chemicals are in powder or granules form since the powder and the granules have less weight than liquid chemicals and are less aggressive then liquid chemicals. Furthermore powder and granules have the advantage over tablets that the powder dissolves more quickly in a solvent if processed by the developer solution preparing means. A drawback of powder is that it may be inhaled by an operator. The present invention allows to minimize the risk of inhaling that powder as set forth below, if granules are used instead of powder.

The supplier of the present invention may be constituted as a hopper. The container has a receiving opening, preferably located at the top of the container and a supply opening, preferably located at the bottom of the container, through which the received chemicals are supplied to the developer solution preparing means.

The chemicals are stored in cartridges or any other suitable tank. Preferably these cartridges are sealed such that the chemicals may not spill out of the cartridge or tank. The mouth portion of the cartridge is attached to the supplier. As mentioned above, the receiving opening of the supplier is preferably located at the top of the supplier. Therefore, the cartridge is preferably turned up side down such that the mouth portion of the cartridge faces the ground. In a dispense position of the cartridge, the mouth or dispense opening of the cartridge faces the receiving opening or protrudes into the container through the receiving opening.

Of course, the present invention is developed to be used in connection with all chemical processing solutions, which can be supplied in dry form to be dissolved. Accordingly, e.g. a silver halide color photographic light-sensitive material after being exposed to light is then processed in the steps such as a series of developing, desilvering, washing and stabilizing steps. And, a silver halide black-and-white photographic light-sensitive material, after exposed to light, is then processed in the series of developing and fixing steps. In these processes, a black-and-while developer or a color developer for carrying out a developing step, a bleacher or a bleach-fixer for a desilvering step, city water or deionized water for a washing step, a stabilizer for a non-water washing step, and a stabilizer for a dye-stabilizing step, respectively.

In general, a processing device according to the invention includes for instance a developing unit, a fixing unit, a desilvering unit, a washing or stabilizing unit and a drying unit and also a means for automatically transporting a photographic light-sensitive material through each of the processing tank or compartments.

The supplier of the present invention comprises an attaching means, which allows for the attachment of the cartridge, in particular of the mouth portion of the cartridge with the supplier. The attaching means are made such that the cartridge is removably attachable to the supplier. The cartridge, in particular its mouth portion, may be releasably coupled with the supplier by means of the attaching means and may be decoupled at any time.

The supplier of the present invention comprises an opening/closing means, which allows opening and closing the receiving opening. The opening/closing means is constituted such that the receiving opening is closed when no cartridge is set on the supplier, i.e. no cartridge is coupled with the supplier. In other words, the opening/closing means keeps the receiving opening closed when a cartridge or tank is not present at the supplier or is not coupled with the supplier. The opening/closing means preferably closes the receiving opening during removal of the cartridge.

The opening/closing means may be constituted such that it opens the receiving opening after the cartridge has been attached to the supplier. Preferably the opening/closing means opens the receiving opening already during the attachment of the cartridge to the supplier.

The opening and closing operations of the opening closing means may be performed electrotechnically e.g. by motors and gears. The attachment and detachment of a cartridge may be monitored by sensors and the opening and closing may be controlled by a control circuit based on the sensor signals. Preferably the opening/closing means is constituted to interact mechanically with said cartridge for said opening and closing operation, when said cartridge is coupled or decoupled by means of the attaching means. For instance, the cartridge may transfer a movement or moment, e.g. rotational or translational to the opening/closing means or vice versa.

Preferably the opening/closing means is arranged and/or constituted such that the receiving opening is closed by the opening/closing means at least as far as the receiving opening is not covered by the cartridge, in particular in as far as not covered by the mouth portion of the cartridge. In other words, there is preferably an overlap between the covering provided by the cartridge and the covering provided by the opening/closing means. In this way the intrusion of particles into the hopper and the spilling of chemicals out of the hopper during the attachment and removal operation of the cartridge is prevented. Preferably the opening/closing means does not block or interfere with the dispense of chemicals out of the cartridge when the cartridge has reached the dispense position at the end of the attachment procedure.

In order to achieve a full covering of the receiving opening during the attachment or removal process of a cartridge, the opening/closing means is preferably in press contact with the cartridge during the attachment or removal. For this purpose the opening/closing means comprises preferably at least one shutter, which is biased against the cartridge.

The attaching means comprises preferably a guiding path to guide the cartridge along a predetermined path during the attachment and during the removal. The opening/closing means is constituted such that it closes at least that part during the attachment or removal of the cartridge along the known path, which are not covered, by the cartridge. For this purpose, the opening/closing means comprises preferably a shutter, which is guided along a path preferably parallel to the above-mentioned guiding path for the cartridge.

Preferably the mouth portion of the cartridge comprises cover projections for covering the receiving opening or for overlapping with the shutter. Preferably the cover projections cover a plane or area approximately perpendicular to the axis of a cartridge or perpendicular to the direction of dispense of chemicals from the cartridge. The plane of these cover projections is preferably approximately parallel to the above-mentioned guiding path. The cover projections allow in interaction with the shutter to keep the receiving opening covered during the attachment and removal process.

The guiding path is preferably constituted such that the attachment of the cartridge is performed in an at least approximately horizontal plain with the mouth portion facing the ground. If the cartridge is pushed along the guiding path, it contacts the shutter biased against the cartridge and moves the shutter away from the receiving opening in contact with the shutter while covering the open part of the receiving opening with its body and its cover projections.

Preferably the mouth portion of the cartridge projects into the hopper through the receiving opening in order to prevent a spilling of chemicals out of the mouth into the environment of the supplier. In order to allow an introduction of this projecting mouth portion of the cartridge into the hopper, preferably a cartridge opening is provided through which that mouth portion may be introduced into the hopper such that the mouth portion projects through the receiving opening into the interior of the hopper when the cartridge is in the dispense position, while said cartridge does not project through the cartridge opening when the cartridge is in the dispense position. Preferably the dispense opening is connected with the receiving opening. While the receiving opening is preferably provided in the upper cover of the hopper and is in particular horizontal, the dispense opening is preferably provided in an upper part of a sidewall of the hopper and is in particular vertical. Preferably the cartridge opening is arranged such that when the cartridge is moved along the guiding part, in particular approximately parallel to the upper cover of the hopper or container, the projecting part of the mouth portion may enter the container via said cartridge opening. In other words the cartridge opening is preferably in a plane, which is inclined to, or approximately perpendicular to a plane in which the receiving opening is located.

In order to prevent the intruding of external particles into the container or the spilling of chemicals out of container, preferably an openable closing member, e.g. a door is provided through which the projecting mouth portion of the cartridge may enter and leave the container during attachment and detachment. This door preferably automatically closes the cartridge opening at the end of the removal or attachment procedure. Preferably the door is supported such that it may be displaced or pushed out of the way by the cartridge if in contact with the cartridge. Preferably the door is biased such that it automatically returns to a position where it closes the cartridge opening when the door is not in contact with the cartridge, i.e. the door behaves like a door of a saloon. Preferably there is no contact between the door and the cartridge if the cartridge is in its dispense position or fully removed from the supplier. The door preferably closes if there is no contact with the cartridge.

Preferably the above-mentioned cover projections of the cartridge are constituted such that they are close to or in contact with the door if the cartridge is attached to the supplier and in it's dispense position. In other words, the cover projection of the cartridge cooperates with the door in order to close the container in the region where the cartridge opening and the receiving opening meet or merge.

Preferably the mouth portion of the cartridge is closed at least during the attachment process and preferably also during the removal process. For this purpose the cartridge preferably comprises a cover, e.g. a lid that closes the mouth portion of the cartridge. Preferably the lid comprises an engaging member, e.g. a hook or an engageable recess. Alternatively the dispense opening of the cartridge may e.g. be closed or covered by a foil.

The supplier of the present invention preferably comprises an opening means in order to open the dispense opening of the cartridge if the dispense opening is closed. If the dispense opening is covered e.g. by a foil or film, the opening means may be a cutting means which cuts the foil or film.

Preferably the dispense opening is closed by a cover which allows for a reclosing after the opening. For instance, the dispense opening may be covered by a lid which may be reattached to the mouth portion of the cartridge such that the dispense opening is closed again. Preferably the cover or lid comprises the engaging member to engage with the opening means in order to allow for an opening of the dispense opening and preferably also a reclosing of the dispense opening in particular after the dispense of the chemicals from the cartridge into the hopper. For instance, the opening means may be constituted as a lever, which engages with the engaging member and which may be actuated e.g. by an operator or motor in order to open and close the dispense opening while the lever is in engagement with the engaging member of the lid. Preferably the opening means is arranged such that it comes in engagement with the engaging member of the cover or lid during attachment of the cartridge.

In a photographic minilab typically a number of different photographic processing chemicals are necessary in order to produce or mix developer solutions for developing a film or photographic paper. Typically three different photographic processing chemicals are necessary for the development of a photographic paper and four different photographic processing chemicals are necessary for the development of a film. Therefore preferably a set of the above-mentioned suppliers is provided, which comprises e.g. seven suppliers. The suppliers are preferably arranged one next to the other. This allows a one-step attachment of a number of cartridges at the same time, e.g. four cartridges for the film development or three cartridges for the paper development. For this purpose the cartridges are preferably arranged in magazines. These magazines are constituted such that the cartridges in these magazines are held at a fixed position relative to each other, i.e. the cartridges are attached to the housing of the magazine, which is in particular rigid and may be e.g. of plastics or may be a card board box. The magazine is preferably divided in different sections, each assigned for one cartridge.

In order to allow an easy attachment of the magazine to the set of suppliers such that each cartridge appropriately engages with the attaching means of each supplier, preferably alignment means are provided at least one supplier and preferably at all suppliers. If the suppliers are provided with the above-mentioned door, then each cartridge has to push the door into the inside of the container in order to enter the container with its projecting mouth portion. Therefore, preferably each door comprises an alignment recess or projection, which cooperates or mates with the mouth portion of the cartridge to be inserted into the container. The alignment means is constituted such that each cartridge enters the guiding path when abutting against the alignment means and pressed against the door. Preferably the alignment means has a shape complementary to the shape of the abutting part of the cartridge.

Alternatively or additionally to the alignment means a magazine mounting means is provided. This magazine mounting means comprises a magazine moving member for moving the magazine in a predetermined mounting direction. The mounting direction corresponds with a direction suitable for attaching each of the cartridges in the magazine to the corresponding supplier. The magazine moving member may e.g. push and/or pull the magazine in the predetermined direction by contacting the magazine. For instance, the magazine moving member may comprise at least one wall which contacts at least one side of the magazine and which, if moved, pushes and or pulls the magazine in the predetermined mounting direction in order to attach each of the cartridges of the magazine to the supplier by means of the attaching means. In particular the magazine is moved such that the above-mentioned door is pushed open such that the projecting mouth portion enters in the container. The magazine moving member may be moved by mechanical or electrical means like a motor or a spring. Preferably the magazine mounting means defines a start position and an end position. For mounting, the magazine is set in the start position by an operator such that the magazine is in contact with the magazine moving member. Additionally the above-mentioned aligning means may be used in order to align the magazine properly with the supplier set. Then the magazine is moved with the assistance of the magazine mounting means form the start position toward the end position in a predetermined mounting direction. During this movement the abovementioned shutter and the door is opened by each of the cartridges. When the magazine is in the end position, each of the cartridges of the magazine is in a position ready for disposal of the photographic processing chemicals. The magazine moving member may be constituted such that it does not only move the magazine from the start position to the end position but also from the end position to the start position.

The magazine mounting means may be (electrically or mechanically) coupled with the opening/closing means (e.g. shutter) such that the opening/closing means assists the magazine moving member for moving the magazine from the start to the end position or from the end position to the start position. The coupling of the magazine mounting means in particular of the magazine moving member with the opening/closing means may be such that a pulling or pushing of the magazine moving member from the end position to the start position results in an acting of each of the opening/closing means (shutter) onto each of the cartridges such that each cartridge is pushed by the opening/closing means from the end position towards the start position, if the operator pulls the magazine moving member from the end position to the start position.

Preferably the magazine mounting means is constituted such that an operator has to apply some force in order to remove the magazine from the start position or from the end position. In this way, it is ensured that the magazine does not unintentionally leave the start position or end position.

The present invention also relates to the use of the above-mentioned cartridge or magazine of cartridges with the supplier of the present invention as well as to a system comprising the cartridges or magazines and the suppliers or set of suppliers.

Furthermore, the present invention relates to the above-mentioned arrangement for preparing a liquid developer solution as in particular described in the above-mentioned parallel application having the title "Automatic Replenishment for a Developing Compartment of a Photo Finishing Apparatus". Finally the invention relates to a photographic minilab, which comprises the suppliers or set of suppliers of the present invention or the above-mentioned arrangement for preparing a liquid developer solution.

BRIEF DESCRIPTION OF THE DRAWINGS

In the following particular embodiments of the present invention are described while referring to figures. Thereby new features of the present invention are disclosed. Features of different embodiments may be combined.

DETAILED DESCRIPTION OF THE INVENTION

Figure 1:
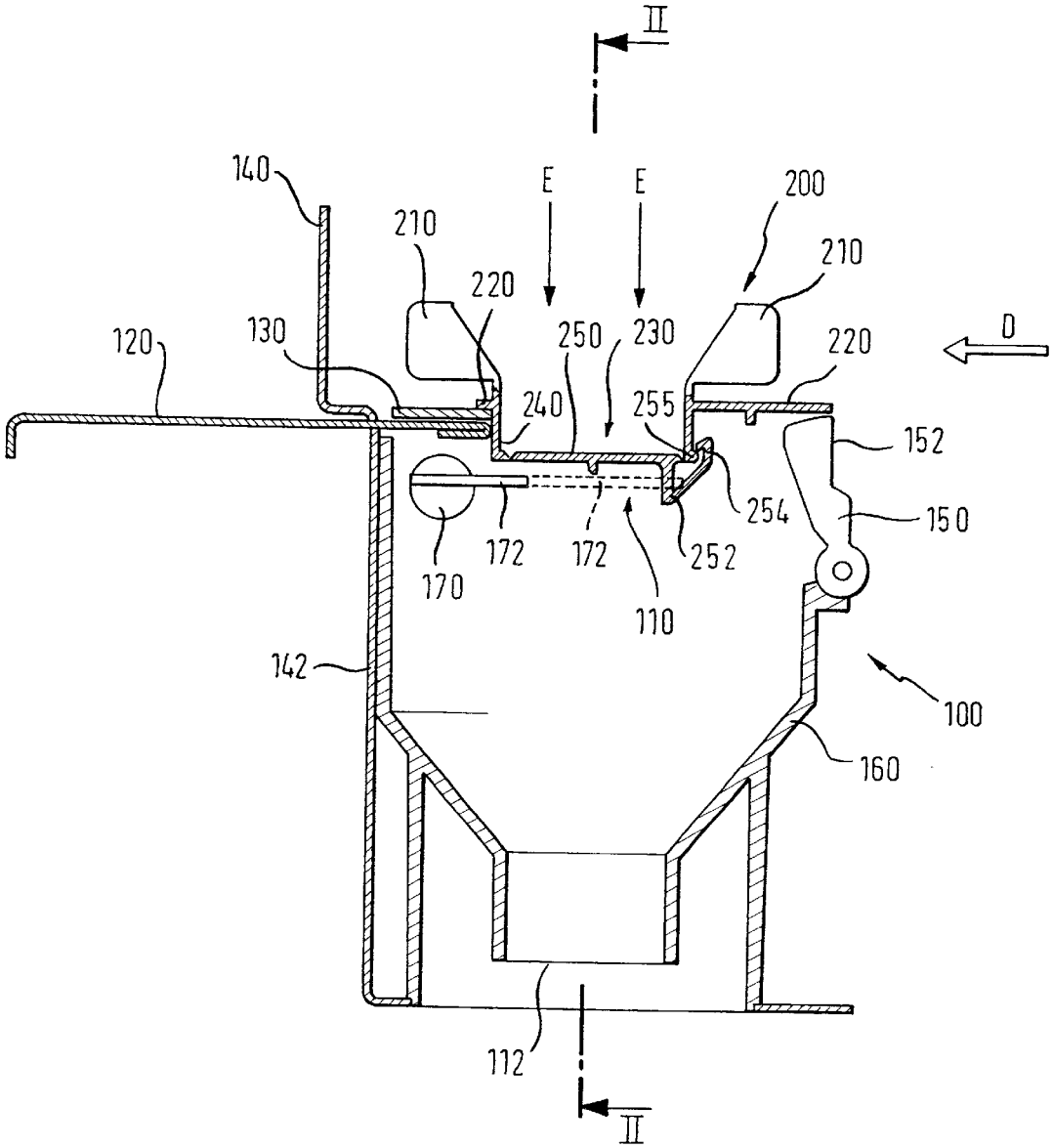
FIG. 1 is a sectional view of a supplier according to the present invention with attached cartridge.

FIG. 1 shows an embodiment of a supplier 100 with an attached cartridge 200. The direction of attachment of the cartridge 200 to the supplier 100 is designated by an arrow D. Of the cartridge 200, only the mouth portion is shown. This mouth portion has a handle 210 in order to grip the cartridge. The mouth portion further comprises a cover projection 220 surrounding the circular mouth opening 230 and meant to cover the receiving opening 110 of the supplier in cooperation with the shutter 120. A top wall 130 surrounds and defines the receiving opening. An upper sidewall 140 of the supplier is integrally formed with a lower sidewall 142 of the supplier and extends vertically. The upper sidewall 140 is used to support and align a magazine (not shown) comprising a number of cartridges at fixed locations.

While it is referred to the preparation of a developer solution, it is clear that the invention extends to all processing solution which are necessary regarding the development exposed films or print paper for photographic prints, like a fixer, a bleach-fixer, a stabilizer, a bleacher or what ever.

For attachment, the magazine together with the cartridge is displaced horizontally in the direction D until the leading sidewall 240 of the mouth portion abuts against the door 150, in more detail against a recess 152 of the door 150. The recess 152 is preferably formed such that it mates with the leading wall 240 of the mouth portion. Typically the leading wall 240 of the cartridge will have a circular shape if viewed in a horizontal cross section. Accordingly the recess 152 has a corresponding or complementary circular shape if viewed in a horizontal cross section.

When the cartridge 200 abuts against the recess 152, the leading part of the cover projection 220 begins with its left and right edge parts (see FIG. 2) to slide upon a part of the top wall 130, which surrounds the receiving opening and extends to the door 150. The door 150 closes the cartridge opening, which is surrounded by a sidewall of container 160 and merges into the receiving opening.

Figure 2:
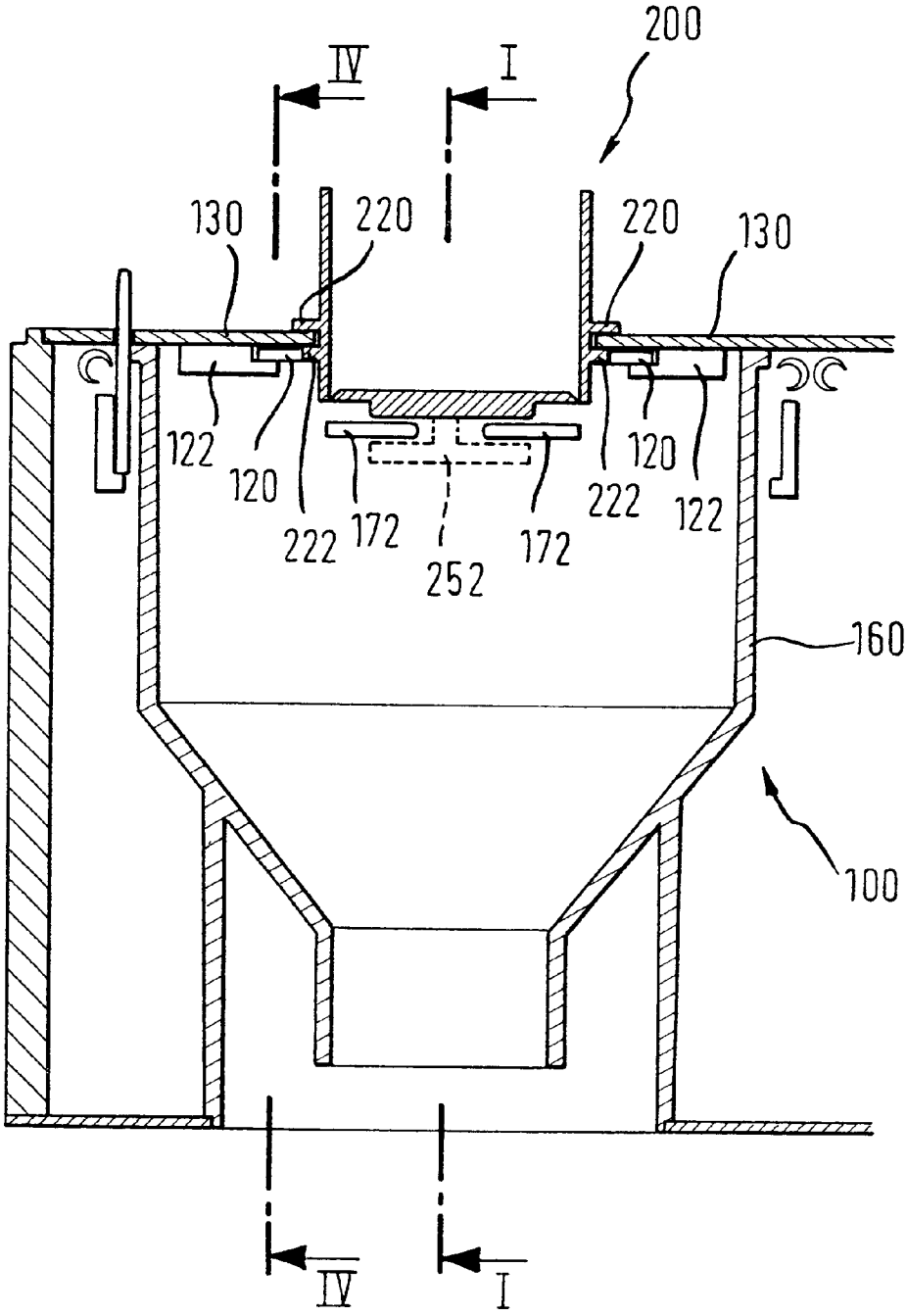
FIG. 2 is a sectional view along the line C—C of FIG. 1.
Figure 3:
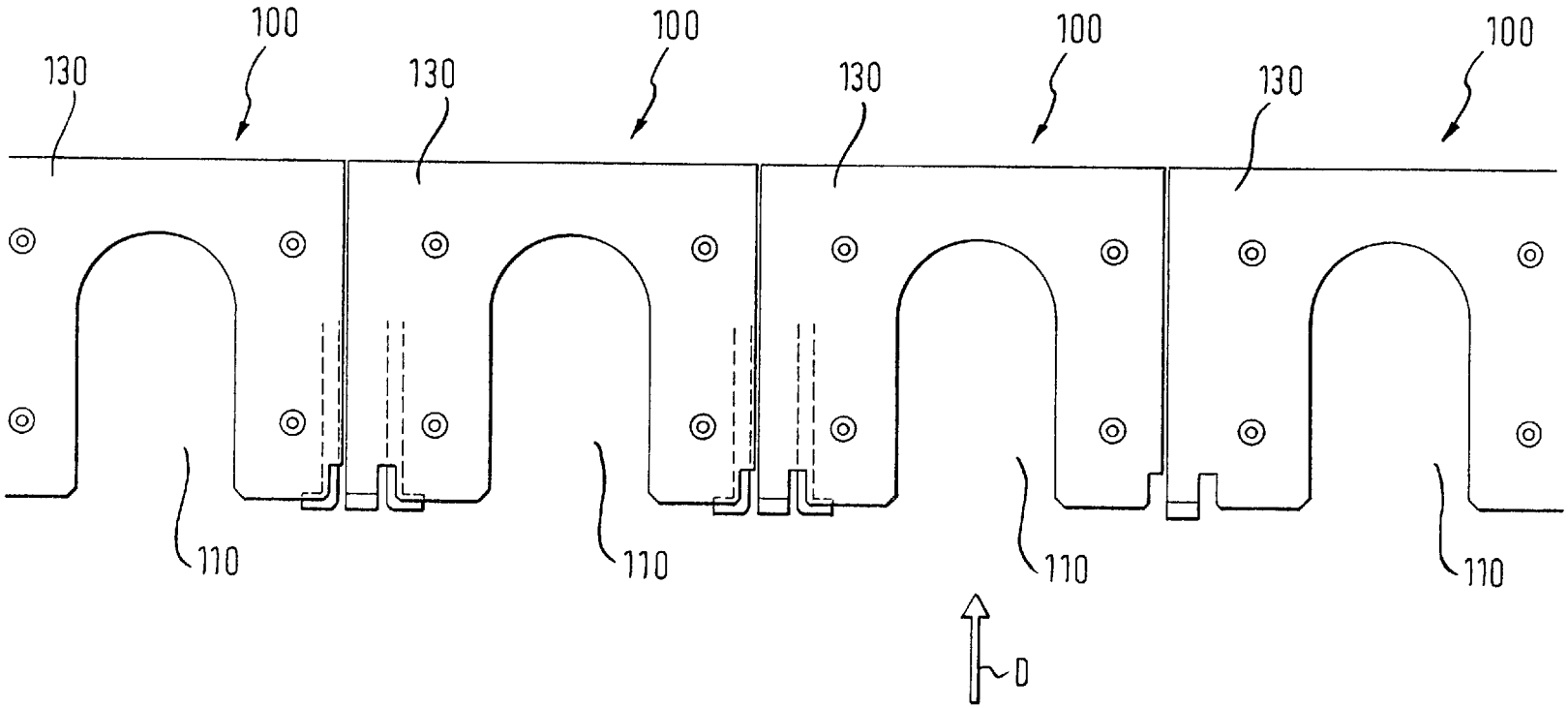
FIG. 3 is a plane view on receiving openings of suppliers arranged one next to the other.
Figure 4:
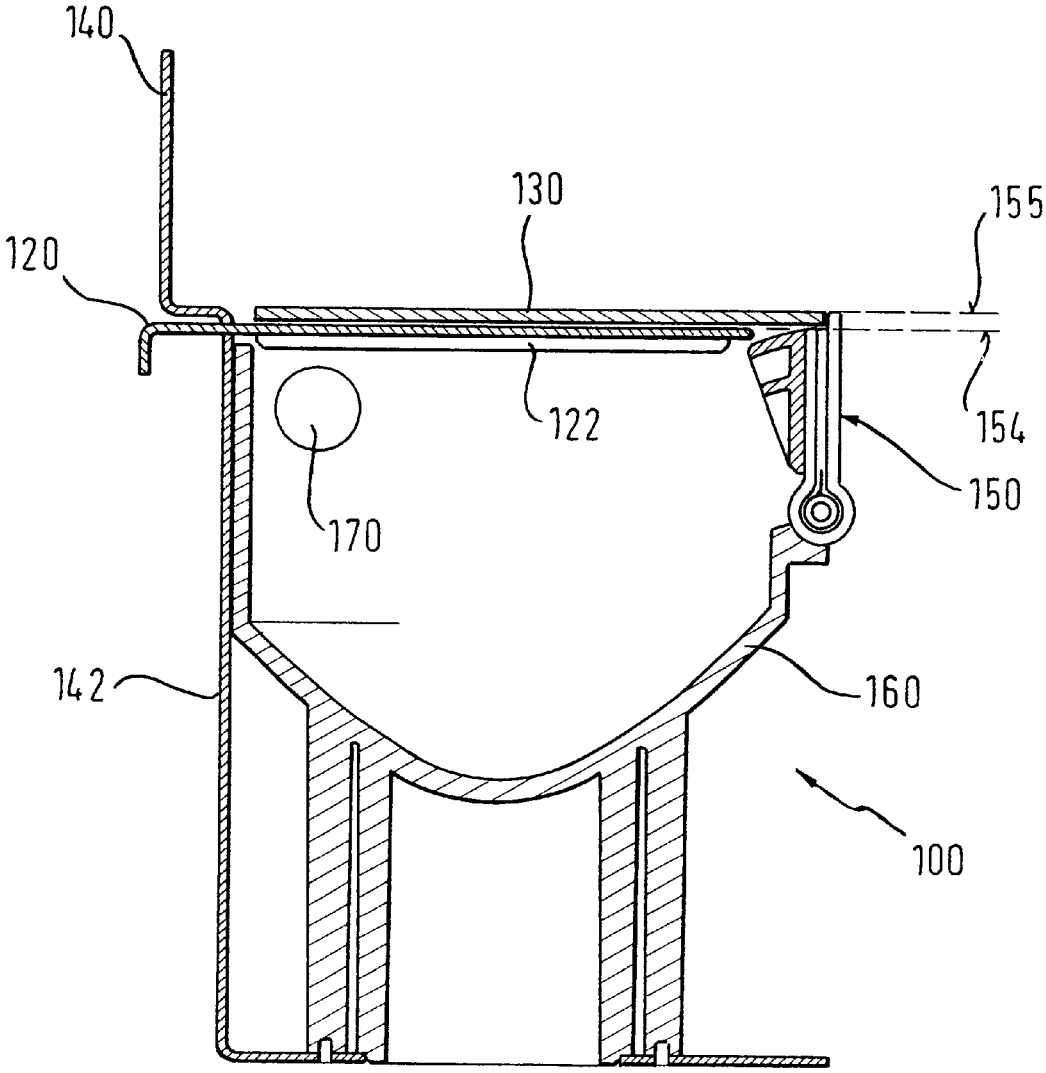
FIG. 4 is a sectional view along the line A—A of FIG. 2, however, without an attached cartridge.

The guiding of the cartridge by means of the top wall 130 is more obvious from the FIGS. 2 to 4. FIG. 3 shows top walls 130 of four suppliers 100 in the plain view. The direction of attachment is again designated by the arrow D. FIG. 1 represents a sectional view along the line BB of FIG. 2, however, with a cartridge. FIG. 2 represents a sectional view along the line CC of FIG. 1, however, with a cartridge. FIG. 4 represents a sectional view along the line AA of FIG. 2.

As can be seen from FIG. 3, the top wall 130 extends to the front end of the supplier, which faces a cartridge to be attached. The cover projections 220 of the cartridge begin to slide on the top wall 130 when the cartridge abuts against the recess 152 of the door 150 as can imagined from FIG. 4. The cover projections 220 slide upon the top wall 230 as can be seen from FIG. 2 when the cartridge is pushed in horizontal direction towards its dispense position. Besides the cover projection 220, the cartridge 200 has preferably additionally a guiding projection 222, which embraces the top wall 130 of the supplier in interaction with the cover projection 220. In this way the top wall 130 serves as a guiding means for the cartridge during the attachment and the cover projection 220 and guiding projection 222 serve as engaging means for an engagement of the cartridge with the supplier during attachment.

The front end of the top wall 130 covers the door 150. For this purpose the door 150 has a reduced height 154 as can be seen in FIG. 4, while that part of the door which projects into the receiving opening 110 has a higher height 155 in order to terminate at the same level as the top wall 130. In summary, the door is formed such that it fully closes the receiving opening and the cartridge opening in cooperation with the top wall 130 and the shutter 120, if a cartridge is not attached.

When a cartridge is pushed in the attachment direction D after it has been aligned by means of the alignment recess 152, the door is pushed in the direction D against a biasing force, which held the door in the upright position. When the door has been forced backward, the leading sidewall 240 of the cartridge abuts against the shutter 120. The shutter 120 is preferably biased in a direction contrary to the attachment direction D. By further pushing the cartridge in the direction D, the shutter 120 is forced backward against the biasing force. That part of the receiving opening, which is opened by the retreating movement of the shutter, is covered by the cartridge and its cover projection 220 during the attachment. The cover projection 220 is in particular formed to cover also that part of the receiving opening, which is between the mouth portion of the cartridge and the door 150. For this purpose the cover projection extends in a direction contrary to the attachment direction D from the mouth portion.

The shutter 120 together with its support 122 on which the shutter slides and together with a biasing spring (not shown) represents an opening/closing means. When the cartridge is removed, the door 150 is pushed open by the mouth portion of the cartridge in a direction contrary to the direction D. This opening of the door 150 is performed against a biasing force. Thus the door 150 behaves like a saloon door. During the removement of cartridge 150 the shutter 120 is urged by its biasing spring (not shown) in the direction contrary to the direction D such that the shutter 120 is in constant contact with the cartridge 200 which intern results in a constant covering of the receiving opening 110 during the removement operation.

When the cartridge 200 is set in the dispense position, as shown in FIG. 1, a dispense of photographic processing chemicals out of the cartridge 200 in the direction E due to gravity is inhibited by a lid 250 which covers the dispense opening of the cartridge. The lid 250 comprises a T-shaped engaging member 252, which is indicated by dashed lines in FIG. 2. The T is turned up side down and the bottom of the T is connected with the lid 250. The lid 250 is provided with a snap projection 254, which snaps in a recess or projection 255 of the mouth portion. Thus the lid 250 represents a captive cover, which may releasably latch with the mouth portion of the cartridge. Thus the dispense opening of the cartridge, through which the chemicals are dispensed in the direction E, may be repeatedly closed and opened by means of the lid 250.

The connection 256 between the lid and the sidewalls 240 of the cartridge is thinned or tapered. The thinned connection serves as a pivot axis for the lid about which the lid is pivoted for opening or closing the dispense opening. In the hopper shaped container 160 a lever 170 is provided, as can be seen in FIG. 1. This lever 170 serves as a mouth opening means to open the lid 250. The lever 170 has a fork-shaped arm 172. In the position of FIGS. 1 and 2 the arm 172 projects horizontally such that the prong of the fork surrounds the foot or bottom of the T of engaging member 252 as can be seen from FIG. 2 and as is indicated in FIG. 1 by the dashed line. The lever 170 may be connected with a motor (not shown) or a manually operable handle (not shown). If the lever is actuated such that the arm 172 rotates downward in FIG. 1, the prongs of the fork abut against the arms of the T 172 and thus force the lid 250 downwards in a pivotal movement. Due to the action of the lever 170, the projection 254 disengages with the projection 255 due to the flexibility or elasticity of the tip of the projection 254.

When the lid 250 is opened, the processing chemicals are discharged into the hopper 160 due to their gravity until the cartridge is empty. Thereafter the cartridge may be reclosed by re-rotating the lever 170 in the position where the arm 172 is horizontal, i.e. the arm 172 forces the snap projection 254 to snap into the projection 255 of the mouth portion. In this way the cartridge is sealed before its removal. Thus it is avoided that an operator may inhale residual chemicals in the cartridge.

As mentioned above, several suppliers may be placed one next to the other. Preferably seven suppliers are provided for a developer solution preparing arrangement or a minilab, i.e. four for the preparing of the developer solution for the films and three for the preparing of the developer solution for the photographic paper. The arrangement may be as shown in FIG. 3. Preferably the cartridges a pre-arranged in a magazine such that the distances between the cartridges correspond to the distances between the receiving openings shown in FIG. 3. In this way, the cartridges may be attached to the suppliers in a one step operation and may be removed in a one step operation. Furthermore, it is assured that an operator do not confuse different cartridges since the cartridges are properly prearranged in the magazine. In this way, the correct kind of cartridge is always attached to the supplier.

Figure 5:
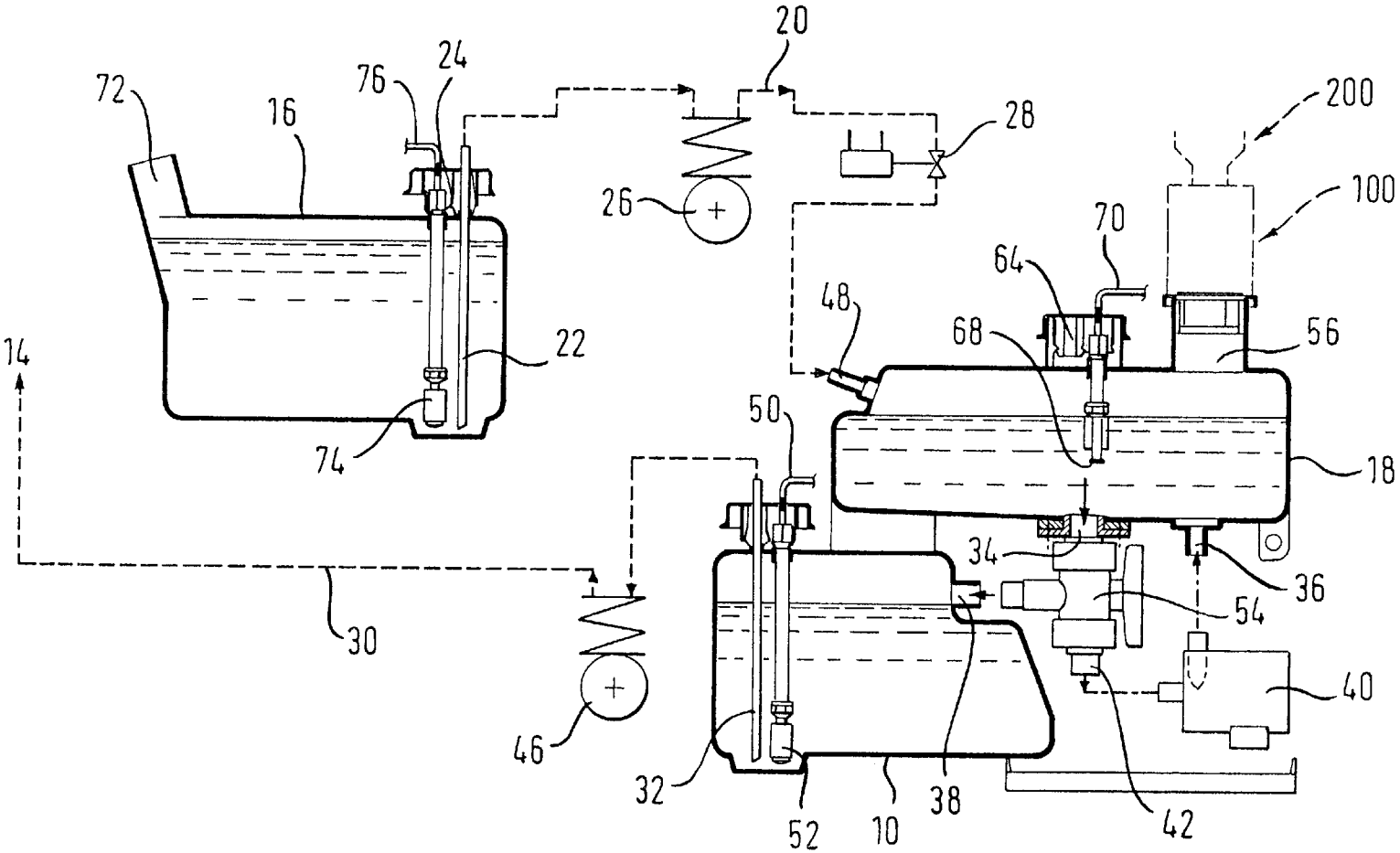
FIG. 5 is a schematic view of a developer solution preparing means.

As mentioned above, the suppliers 100 of the present invention and the corresponding cartridges 200 may be connected with the developer solution preparing means shown in FIG. 5, which is described in the following. All reference numbers below 100 relate to the developer solution preparing means, which represents in connection with the above discussed supplier 100 (dashed lines in FIG. 4) a developer solution preparing arrangement. The chemicals in the hopper 160 are supplied to the developer solution preparing means through the supply opening 112.

In the figure, a storage container 10 is connected via a sucking pipe 32 and a pumping means 46 to a pipe connection 30, which ends in a developer compartment represented by the reference number 14.

When the pump, which for instance can be a transfer bellow pump, has emptied the storage container 10, a sensor 52 is able to detect this state of the storage container 10. The sensor holder of the sensor 52 can also include a vent pipe 50 to allow a pressure balance in the container 10 when developer is withdrawn or supplied to the tank 10.

The tank 10 has an inlet opening 38, which is connected to an outlet opening 34 of a mixing tank 18. The outlet opening 34 is connected to the inlet opening 38 via a three-way-valve 54, which can be switched in two different positions. In one position the three-way-valve 54 provides a connection between the mixing tank 18 and the storage container 10. In the other setting, the valve 54 connects the outlet opening 34 of a tank 18 to a connecting piece 42 of the valve 54. Said valve is fitted via a pipe to a pump 40 which has the purpose of moving the liquid in the tank 18 by sucking the liquid to the outlet opening 34 and re-feeding the liquid through another inlet 36 of the mixing tank 18 back into the mixing tank. Accordingly, the pump 40 generates a movement or flow in the tank to support any chemical reactions, such as for instance a dissolution of components introduced into the tank 18, and to help to provide a homogeneous developer solution which is composed of the solvent stemming from a reception compartment 16 and the dry components stemming from the supplier 100 which are replenished by the cartridges 200.

The mixing tank 18 has two inlet openings. The inlet opening 56 connects a supplier or a number of suppliers to the mixing tank 18. The inlet opening 48 introduced the solvent from the reception container 16 through a pipe 20 into the mixing tank 18.

The solvent in the reception container 16, which can be replenished via an opening 72 into the container 16 is withdrawn via a sucking pipe 22. The sucking pipe 22, which is connected to the connection pipe 20, is connected to the container 16 via an opening 24. The opening 24 also supports a sensor 74 fixed to a holder through which a vent pipe 76 is also connected to the inner space of the container 16. The vent pipe 76 allows for pressure balance in the container 16 when the level of the solvent in the container 16 changes. The solvent can be transferred by a pump means 26 and the connecting pipe 20. To exactly control the amount of solvent to be supplied to the mixing tank 18, a valve, and in particular a solenoid valve 28, can be installed in the course of the connecting pipe 20 behind the pump 26.

In addition, the mixing tank 18 includes a level sensor 68, which is able to detect the levels of the amount of liquid existent in the tank 18. Moreover, the fixture of the level sensor 68 is provided with a vent pipe 70 to allow for a pressure balance in the tank 18. The level sensor 68 and the vent pipe 70 are introduced or connected, respectively, to the inner space of the tank 18 via an opening 64.

All the sensors 52, 68, 74 of this arrangement can activate the necessary actuators to accomplish a proper function of the arrangement according to the invention. Thus, the sensor 52 can actuate the three-way-valve 42 or alternatively a two-way-valve to replenish the container 10 with fresh developer from the mixing tank 18. In case of the appliance of a two-way-valve, the mixing loop including the pump 40 is always open and only an additional connecting conduit between the mixing tank 18 and the storage container 10 is controlled by such a two-way-valve. The pump 46 can be activated by one or several sensors in the development compartment, if the used developer in the development compartment has been poured out and fresh developer from the container 10 has be replenished into the development compartment 14. The sensor 68 can detect when the mixing tank 18 is empty and can, after the valve 54 has been closed, activate the solenoid valve 28 and, if necessary, the pump 26, to introduce solvent, e.g. water, from the container 16 into the tank 18. At the same time, the signal from the sensor 68 can activate the supplier or suppliers 100 to introduce the necessary amount of dry ingredients for the developer solvent into the tank 18.

When the level sensor 68 detects that the maximum level has been reached, or, if possible beforehand, the valve 54 can be controlled to be set to connect a mixing pump 40 to the mixing tank 18.

Of course, the different functions said forth above could also be accomplished by a central control processor or a central control computer, which is part of the development apparatus or the minilab, which incorporates the development compartment 14.

The present invention can be used also for all other processes in connection with the development of photographic material, i.e. all developing, desilvering, washing, and stabilizing processes, to dissolve and supply the granules of the necessary chemical compounds for each of the steps.

Of course, the photographic material can be a photographic film or a photographic print paper, both for colour and black-and-white shots and prints.

Accordingly, the combination of different tanks and containers can be arranged for preparing not only a developer, but also a bleacher or a bleach-fixer for a desilvering step, a stabilizer for a non-water washing step and a stabilizer for a dye-stabilizing step, respectively.

Figure 6:
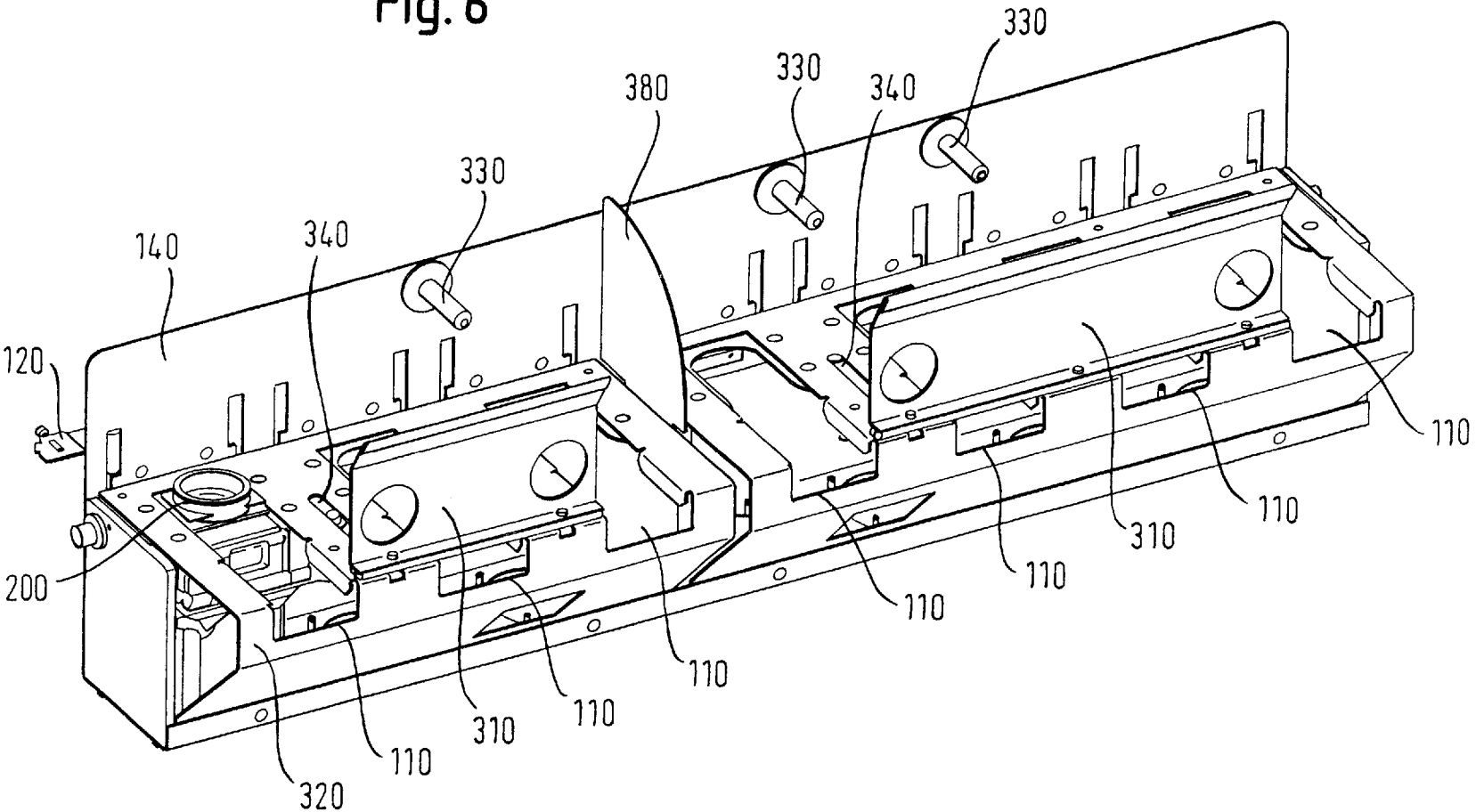
FIG. 6 is a perspective view of a supplier set comprising a magazine mounting means.

FIG. 6 shows a perspective view of a supplier set having in total seven receiving openings 110. There are three receiving openings 110 on the left side and four receiving openings 110 on the right side. The supplier set has a separation wall 380, which separates two magazines. The magazine meant for the left side has three cartridges and the magazine meant for the right side has four cartridges. The receiving opening on the ut-most left side is shown as if a mouth portion of a cartridge is attached. Therefore a shutter 120 has been pushed to the backside by this mouth portion. In addition to the constitution of the supplier shown in the FIGS. 1, 2, and 4, a frame 320 is provided which is meant for assisting the introduction of the cartridges. The frame projects in forward direction, i.e. contrary to the attachment direction D from the set of suppliers (see also FIG. 8). The projection is such that a magazine may be placed on the upper side of the frame 320 with the mouth portions of the cartridges facing downwards and projecting through an opening of the frame 320 in downward direction. This opening of the frame 320 continuous in the receiving opening 110.

While the upper sidewall 140 is provided on the backside of the supplier set shown in FIG. 6, a pushing wall 310 is provided at the front side and serves as a magazine moving member. There two pushing members, one for a magazine with three cartridges on the left side and one for a magazine with four cartridges on the right side. For mounting a magazine, the magazine is placed on the upper side of the frame 320 as mentioned above and set between the upper side wall 140 and the pushing member 310 such that one side wall of the magazine contacts the pushing member 310. The pushing member 310 is then pushed in the direction D. During the movement of the pushing member 310, the pushing member 310 interacts with a groove 340. In this way the groove 340 defines the direction of movement of the pushing member. The pushing member may be reciprocated between the two ends of the groove 340. The ends of the groove define the amplitude of the reciprocating movement of the pushing member 310.

Aligning bars 330 are provided, which project in forward direction (contrary to the attachment direction D) from the upper sidewalls 140. These aligning bars cooperate with complementary recesses in the magazine sidewalls. In this way it may be prevented that a magazine is wrongly attached to the set of suppliers. The pushing member 310, frame 320, aligning bars 330 and groove 340 represent parts of the magazine mounting means.

Figure 7:
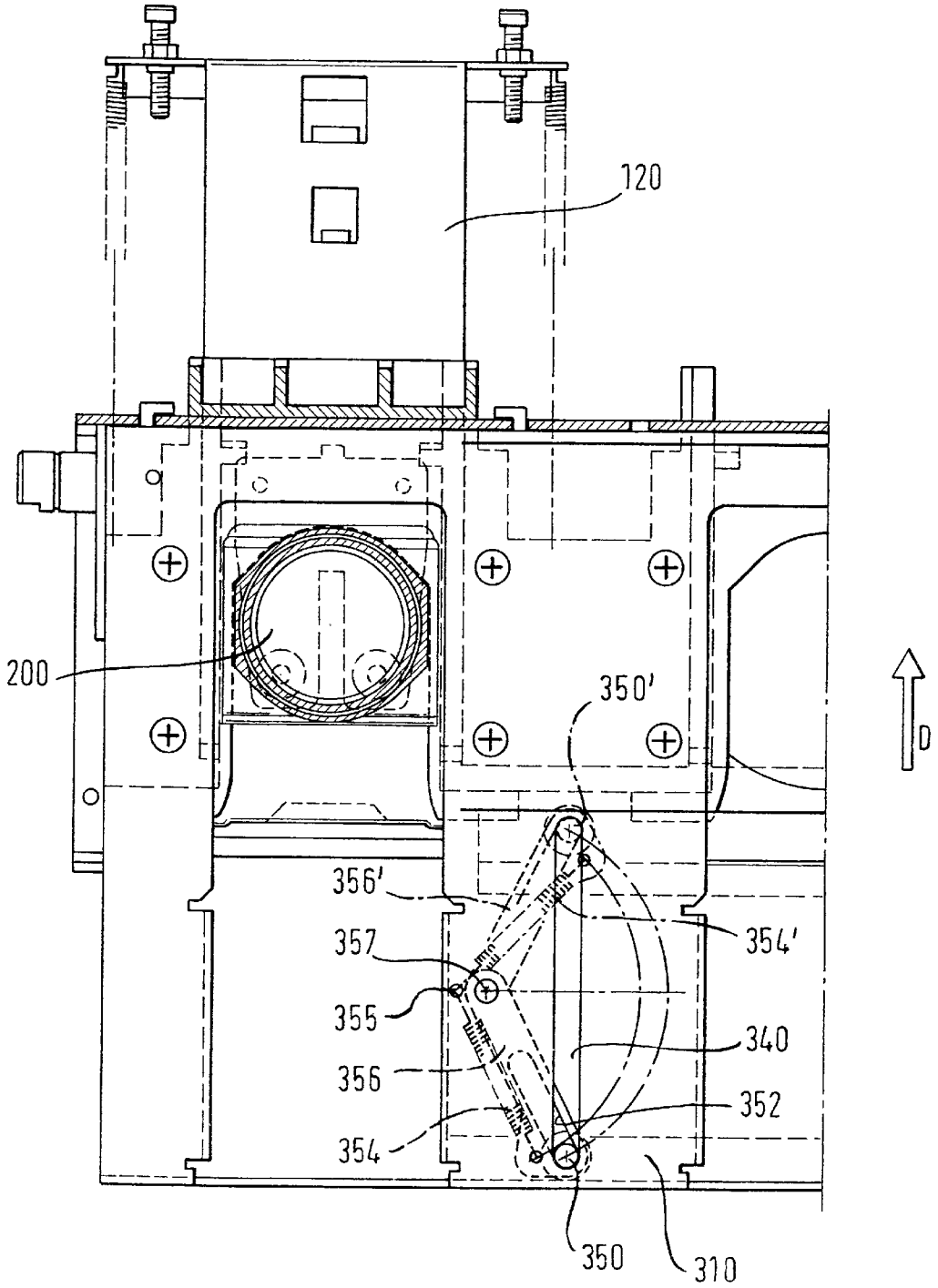
FIG. 7 is a plan view of a supplier and a magazine mounting means.

FIG. 7 shows in more detail an assisting mechanism of the magazine mounting means. This assisting mechanism consists of a pivotable rod 356 and a pivotable spring 354, which rotate around an axis 357 and 355 at one end, respectively. At the other end, the spring and the rod are respectively connected with the pushing member 310 via a coupling member 350, which interacts with the grove and which may slide along the grove 340. The spring 354 is biased to urge the pushing member into the start position (and into the end position, see below). The spring has to be compressed in order to move the pushing member from the start position towards the end position. During this movement the coupling member 350 does not only slide within the grove 340 but also within a grove 352 of the rod 356.

When the coupling member 350 is closest to the axis 357 and 355, the spring 354 is maximally compressed and the coupling member 350 has reached the opposing end of the grove 352 of the rod 356. This position is approximately reached at half way between the start position and the end position. Thereafter the movement toward the end position is assisted by the force of the spring 354. In this way the spring does not only urge the pushing member in the start position but also into the end position. Thus an operator has to apply force in order to remove the magazine from the start position or from the end position. In this way, an unintentional movement of the magazine, which may result in the spilling of chemicals, may be avoided.

The lower surface 320, which is inclined towards the supplier, may be used to collect chemicals, which are unintentionally spilled out of the cartridges.

Figure 8:
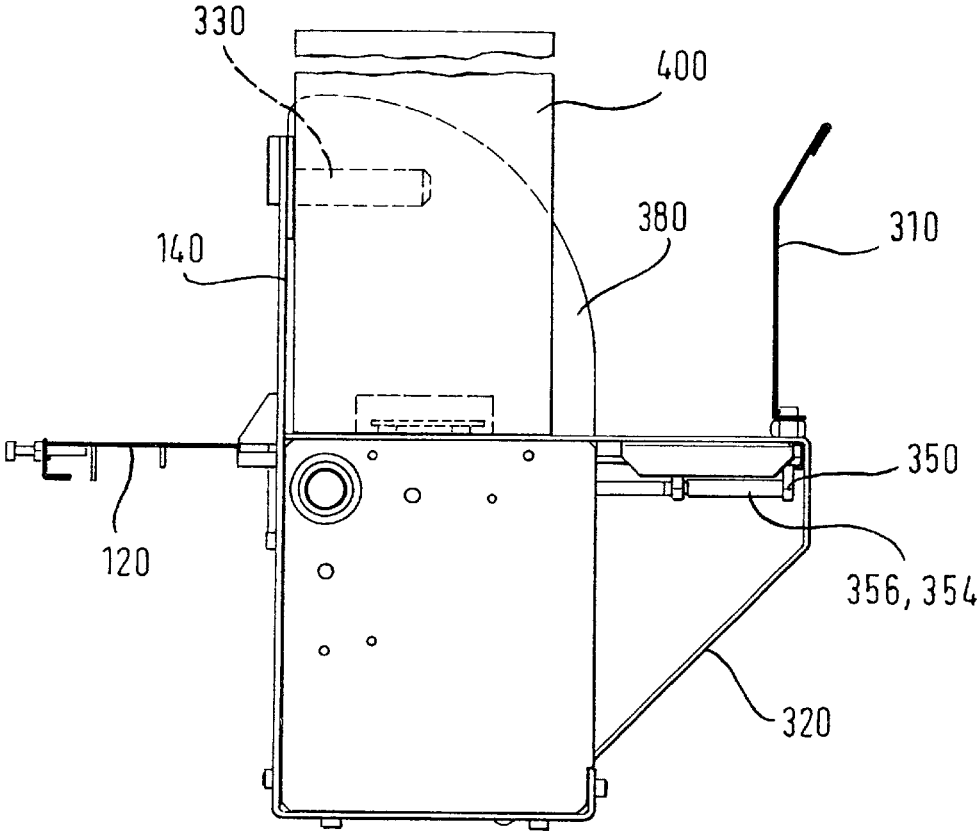
FIG. 8 is a side view of a supplier comprising a magazine mounting means and showing a magazine.

FIG. 8 shows a side view of the supplier set having the magazine mounting means. The pushing wall 310 is in the start position and a magazine 400 is set in the end position and cooperates with the aligning bar 330. The shutter 120 has been pushed to the left side (backside) by the cartridge, which is inside of the magazine. During the movement of the magazine by the pushing member 310 from the start position to the end position (not shown in FIG. 8), the pushing member 310 is in contact with the right side of the magazine 400.

What is claimed is:

1. A photographic processing chemical supplier for supplying photographic processing chemicals for processing exposed light-sensitive material to a processing solution preparing means, comprising:

a container having a receiving opening through which said photographic processing chemicals are receivable in said container and a supply opening through which the received photographic processing chemicals are suppliable out of said container to said processing solution preparing means, wherein an attaching means is provided such that a cartridge is removably attachable to the supplier by means of said attaching means; and opening/closing means for opening and closing said receiving opening constituted such that said receiving opening is closed if said cartridge is removed and such that said receiving opening is openable or open if said cartridge is attached.

2. The supplier of claim 1, wherein said opening/closing means is constituted to interact mechanically with said cartridge when said cartridge is attached to or removed from said supplier by means of said attaching means, wherein said interaction results in a closing of said receiving opening, when said cartridge is removed.

3. The supplier of claim 2, wherein said interaction results in a opening of said receiving opening when said cartridge is attached.

4. The supplier of claim 2, wherein, during a removal of said cartridge, said interaction results in a closing of said receiving opening at least as far as said receiving opening is not covered by said cartridge.

5. The supplier of claim 3, wherein, during a removal of said cartridge, said interaction results in a closing of said receiving opening at least as far as said receiving opening is not covered by said cartridge.

6. The supplier of claim 4, wherein said attaching means comprises a guiding path constituted for guiding said cartridge for said attachment and for said removal such that said interaction results in a closing of the receiving opening by said opening/closing means at least as far as not covered by said cartridge during said attachment and said removal along said guiding path.

7. The supplier of claim 6, wherein said opening/closing means comprises a shutter movable along said guiding path to close or open the receiving opening and movable by said cartridge when said cartridge is guided along said guiding path during attachment.

8. The supplier of claim 1, wherein said container comprises a cartridge opening through which parts of said cartridge are receivable in the container and removable from said container and which is closable by an openable closing member which is openable by contact with said cartridge during removal or attachment of said cartridge, and wherein said cartridge opening is located such that it is closable by said closing member if said cartridge is in a predetermined dispense position for dispensing the chemicals.

9. The supplier of claim 1, comprising a mouth opening means for opening a mouth portion of said cartridge such that said chemicals may be dispensed through the mouth portion, if said cartridge is in a predetermined dispense position, where the chemicals are to be dispensed in the container.

10. The supplier of claim 1 wherein said photographic processing chemicals are dry chemicals in power or granular form.

11. A photographic processing chemical supplier set for supplying photographic processing chemicals for processing exposed light-sensitive material to a processing solution preparing means, comprising a plurality of containers having a receiving opening through which photographic processing chemicals are receivable in said containers and a supply opening through which the received photographic processing chemicals are suppliable out of said containers to a processing solution preparing means, wherein an attaching means is provided such that a cartridge is removably attachable to one of the plurality of containers by means of said attaching means; and opening/closing means for opening and closing said receiving opening are constituted such that said receiving opening is closed if said cartridge is removed and such that said receiving opening is openable or open if said cartridge is attached.

12. The supplier set of claim 11, characterized by a magazine mounting means for mounting a magazine to the supplier set, said magazine comprising a plurality of said cartridges, wherein said magazine mounting means comprises a magazine moving member which, if moved, transfers a force to the magazine for moving the magazine in a predetermined mounting direction which coincides with the direction of attachment of each cartridge of said magazine by said attaching means.

13. The supplier set of claim 11, characterized by an aligning means for allowing an alignment of a magazine comprising a plurality of said cartridges with said supplier set by contact of said magazine with said aligning means, wherein said aligning means is constituted such that the alignment of the magazine results in an alignment of each cartridge of said magazine to one corresponding supplier in a position suitable for attaching each of said cartridges to the supplier.

14. A photographic processing chemical magazine having cartridges as claimed in claim 12, said cartridges are arranged at predetermined positions in said magazine to meet the aligning means, wherein each of the cartridges of said magazine is alignable with one aligning means of one supplier of said supplier set.

15. The supplier of claim 11 wherein said photographic processing chemicals are dry chemicals in powder or granular form.

16. A photographic processing chemical cartridge for use with a container having a receiving opening through which said photographic processing chemicals are receivable in said container and a supply opening through which the received photographic processing chemicals are suppliable out of said container to said processing solution preparing means, wherein an attaching means is provided such that a cartridge having engaging means engageable with said attachment means for removable attachment, is removably attachable to the container by means of said attaching means; and opening/closing means for opening and closing said receiving opening constituted such that said receiving opening is closed if said cartridge is removed and such that said receiving opening is openable or open if said cartridge is attached.

17. A liquid developer solution preparing arrangement for preparing at least one liquid processing solution for processing photosensitive material comprising:

a storage container for storing said liquid processing solution to be fed to a processing compartment;

a container having a receiving opening through which photographic processing chemicals are receivable in said container and a supply opening through which the received photographic processing chemicals are suppliable out of said container to a processing solution preparing means, wherein an attaching means is provided such that a cartridge is removably attachable to the container by means of said attaching means; and opening/closing means for opening and closing said receiving opening are constituted such that said receiving opening is closed if said cartridge is removed and such that said receiving opening is openable or open if said cartridge is attached, for supplying the photographic processing chemicals to a mixing tank; and a reception container for receiving and storing a solvent, wherein said mixing tank is located between 1) said container and said reception container and 2) said storage container, said container, said reception container and said storage container being connected to said mixing tank.

18. The liquid developer solution preparing arrangement of claim 17 wherein said photosensitive material is photosensitive film material or photosensitive paper material.

19. The liquid developer solution preparing arrangement of claim 17 wherein said liquid processing solution is selected from the group consisting of a developer, a bleacher, a bleach-fixer and a stabilizer.

20. The liquid developer solution preparing arrangement of claim 17 wherein said processing compartment is a development compartment of a processing apparatus.

21. A photographic processing chemical cartridge for use with a plurality of containers having a receiving opening through which photographic processing chemicals are receivable in said containers and a supply opening through which the received photographic processing chemicals are suppliable out of said containers to a processing solution preparing means; wherein an attaching means is provided such that a cartridge having engaging means engageable with said attaching means for removable attachment, is removably attachable to one of the plurality of containers by means of said attaching means; and opening/closing means for opening and closing said receiving opening are constituted such that said receiving opening is closed if said cartridge is removed and such that said receiving opening is openable or open if said cartridge is attached.

22. A liquid developer solution preparing arrangement for preparing at least one liquid processing solution for processing photosensitive material, comprising:

a storage container for storing said liquid processing solution to be fed to a processing compartment;

a plurality of containers having a receiving opening through which photographic processing chemicals are receivable in said containers and a supply opening through which the received photographic processing chemicals are suppliable out of said containers to a processing solution preparing means;

wherein an attaching means is provided such that a cartridge is removably attachable to a container of the plurality of containers by means of said attaching means; and opening/closing means for opening and closing said receiving opening are constituted such that said receiving opening is closed if said cartridge is removed and such that said receiving opening is openable or open if said cartridge is attached for supplying the photographic processing chemicals to a mixing tank;

a reception container for receiving and storing a solvent;

wherein said mixing tank is located between 1) the plurality of containers and said reception container and 2) said storage container, said plurality of containers, said reception container and said storage container being connected to said mixing tank.

23. The liquid developer solution preparing arrangement of claim 22 wherein said photosensitive material is photosensitive film material or photosensitive paper material.

24. The liquid developer solution preparing arrangement of claim 22 wherein said liquid processing solution is selected from the group consisting of a developer, a bleacher, a bleach-fixer and a stabilizer.

25. The liquid developer solution preparing arrangement of claim 22 wherein said processing compartment is a development compartment of a processing apparatus.

* * * * *